US005340070A

United States Patent [19]

Soma

[11] Patent Number: 5,340,070

[45] Date of Patent: Aug. 23, 1994

[54] LEG SHAVE PLATE

[76] Inventor: Betsy A. Soma, 896 Tartan Trail, Bloomfield Hills, Mich. 48304

[21] Appl. No.: 95,896

[22] Filed: Jul. 21, 1993

[51] Int. Cl.[5] ..... A47B 96/06

[52] U.S. Cl. ..... 248/220.1; 4/574.1; 248/205.3

[58] Field of Search ..... 248/220.1, 235, 205.3; 211/90; 4/574.1, 611; D23/304

[56] References Cited

U.S. PATENT DOCUMENTS

| | | | |
|---|---|---|---|
| D. 190,624 | 6/1961 | Morrison | D23/304 |
| D. 340,508 | 10/1993 | Hocker | D23/304 |
| 1,232,223 | 7/1917 | Clarke . | |
| 2,182,532 | 12/1939 | Bentz . | |
| 2,456,174 | 12/1948 | Clark . | |
| 2,576,883 | 11/1951 | Koski . | |
| 2,810,137 | 10/1957 | Olsson . | |
| 3,275,283 | 9/1966 | Rauch . | |
| 3,396,413 | 8/1968 | Kaufman . | |
| 3,494,584 | 2/1970 | Dubey | 248/219.4 |
| 3,713,180 | 1/1973 | Martin . | |
| 4,248,398 | 2/1981 | Doyel | 248/220.1 |
| 4,356,575 | 11/1982 | Terry | 4/574.1 X |
| 4,489,448 | 12/1984 | Cairo | 4/574.1 |
| 4,708,310 | 11/1987 | Smith | 211/90 |
| 5,228,151 | 7/1993 | Livingston-Capoano | 4/574.1 |

*Primary Examiner*—J. Franklin Foss
*Attorney, Agent, or Firm*—Krass & Young

[57] ABSTRACT

A ladies leg shave plate or fixture is mounted in the shower stall or in a bathing area of the bathroom. It has a unitary body having a vertically extending mount portion and a forwardly extending, downwardly inclined foot portion integral with the mount portion. The foot portion has upper and lower surfaces, with the upper surface providing an area for the woman to place the ball of her foot to permit her to conveniently shave her leg. The angle of inclination for the upper surface is in the range of 15° to 25°.

22 Claims, 2 Drawing Sheets

LEG SHAVE PLATE

BACKGROUND OF THE INVENTION

This invention relates to a bathroom fixture or accessory which may be conveniently mounted in a shower stall or in an adjacent area within the confines of the bathroom to permit and to assist a woman to shave her leg while having the ball of the foot resting upon the fixture. More particularly, this invention relates to a ladies leg shave plate which may be inserted in any corner or against any flat wall whether in the shower stall or in an adjacent area and at a level above the floor which is convenient for the woman to place the ball of her foot when shaving her leg. The leg shave plate acts as a balancing tool for a person to shave their leg while showering.

The present invention provides a simple and relatively inexpensive fixture which may be quickly and easily placed in a convenient position within the shower stall or an area adjacent thereto at a height which will permit the woman to shave her leg while standing or while seated on a seat provided in the shower stall or in an adjacent area.

In the past, a woman has used the rim of the bathtub, a stool or other device to raise her foot above the floor so that she could conveniently shave her leg. Depending upon the physical agility of a woman, the standing on one's foot while shaving the leg causes a greater or lesser degree of inconvenience and can result in serious injuries should the person slip on the bathroom tub while shaving. In a stall shower there is no ledge or surface for the woman to place her foot and as a result thereof, leg shaving is very difficult to do in a stall shower. The shave plate will help a woman balance herself while shaving.

Prior art foot support devices have been suggested for pedicure or similar purposes. Such devices have not proven successful for a number of functional and economical reasons. In particular, some of the prior art devices have been cumbersome to use or the user found the prior art devices to be in the way when not in use .

SUMMARY OF THE INVENTION

A significant aspect of the present invention is the recognition that the ladies leg shave plate or fixture may be installed in a shower stall or on a wall in the bathroom such that it is convenient to use, is of a size to fit the ball of the foot of the woman and makes leg shaving a much easier and enjoyable experience as it allows her to balance herself while shaving.

Accordingly, it is a feature of the present invention to provide a ladies leg shave plate or fixture comprising a unitary body having a vertically extending mount portion and a forwardly extending, downwardly inclined foot portion integral with the mount portion, such that the foot portion has an upper surface providing an area for the woman to place the ball of her foot to permit her to conveniently shave her leg.

Another feature of the present invention is to provide a ladies leg shave plate or fixture having a unitary body which can be permanently mounted in the shower stall or in an area adjacent thereto within the confines of the bathroom area. The woman can place the fixture at a height above the floor where it is convenient for her to stand while shaving her leg or adjacent a seat where she may be seated when using the ladies leg shave plate.

Still another feature of the present invention is to provide a ladies leg shave plate for shower stalls or for adjacent bathroom areas which has sufficient structural strength to permit the placing of the ball of the foot of the user thereon and is simple and economical to manufacture and install.

A further feature of the present invention is to provide a ladies leg shave plate of the aforementioned type having a unitary body which is made from any suitable material such as ceramic or plastic and which is provided with one or more openings to permit water to drain from the body. In addition, the opening is designed to retain the handle of the razor or the head of the razor when the razor is not used for shaving.

A still further feature of the present invention is to provide a ladies leg shave plate or fixture of the aforementioned type wherein the vertically extending mount portion of the unitary body is flat and of rectangular configuration so as to permit it to be conveniently mounted on the shower stall wall or the wall of an adjacent area.

Another feature of the present invention is to provide a ladies leg shave plate of the aforementioned type wherein the vertically extending mount portion comprises a pair of flanges which are integrally connected and spaced 90 degrees apart so as to permit the fixture to be mounted in the corner of the shower stall or adjacent area.

A further feature of the present invention is to provide a ladies leg shave plate of the aforementioned type wherein the forwardly extending, downwardly inclined foot portion has an upper surface which is either flat or is provided with a series of alternate ribs and indentations upon which the woman places the ball of her foot when shaving to assist in preventing the foot from slipping from the fixture.

Other objects, features and advantages of the invention will become apparent from a consideration of the following detailed descriptions taken in connection with the accompanying drawings wherein a satisfactory embodiment of the invention is illustrated. However, it should be appreciated that the invention is not limited to the details disclosed but includes all such variations and modifications which can come within the spirit of the invention and the scope of the appended claims.

DESCRIPTION OF THE PREFERRED EMBODIMENT

Figure 1:
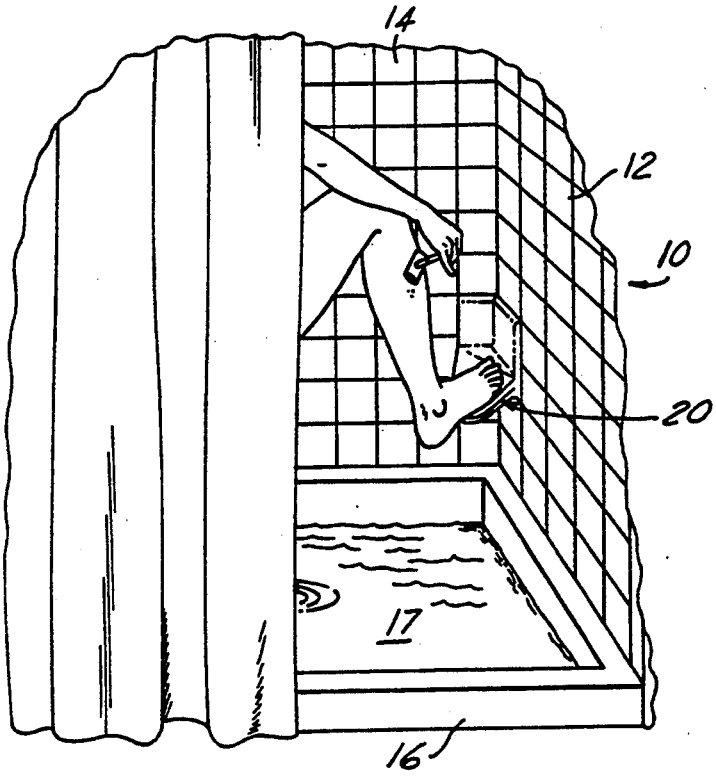
FIG. 1 is a fragmentary perspective view of a shower stall showing the ladies leg shave plate or fixture mounted in the corner of the shower stall.
Figure 2:
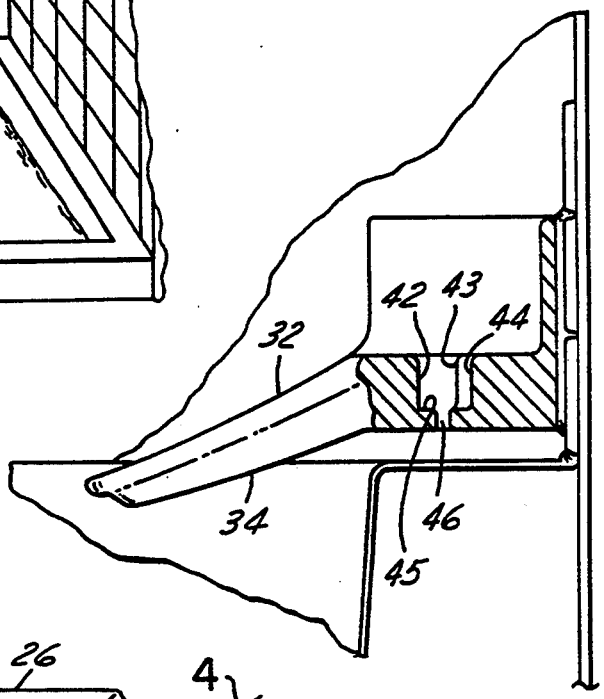
FIG. 2 is an elevational view of the ladies leg shave plate illustrated in FIG. 1, with parts broken away and in section to illustrate certain features thereof.

Referring now to the drawings, FIG. 1 illustrates a fragmentary view of a shower stall 10 having interior tile walls 12 and 14, a base 16, a floor 17 and a curtain or door 18. The shower stall includes the usual shower head and water fixtures, not shown. It should be appreciated that the shower stall 10 may be integrally built in the bathroom or bathing area such as with new home constructions or may be a device installed as a separate unit in remodeled housing.

The ladies leg shave plate or fixture 20 is mounted in the corner of walls 12 and 14 of the shower stall 10 as shown in FIG. 1. The fixture 20 may be mounted at any elevation convenient to fit the needs of the woman normally utilizing the fixture 20 when shaving her leg. In certain shower stall a seat may be provided which is a permanent part of the stall 10 and thus the fixture 20 may be located at a lower elevation so that the person would be seated at the time she shaves her leg. Thus the fixture 20 would be mounted closer to the floor 17 of the shower stall 10.

Figure 3:
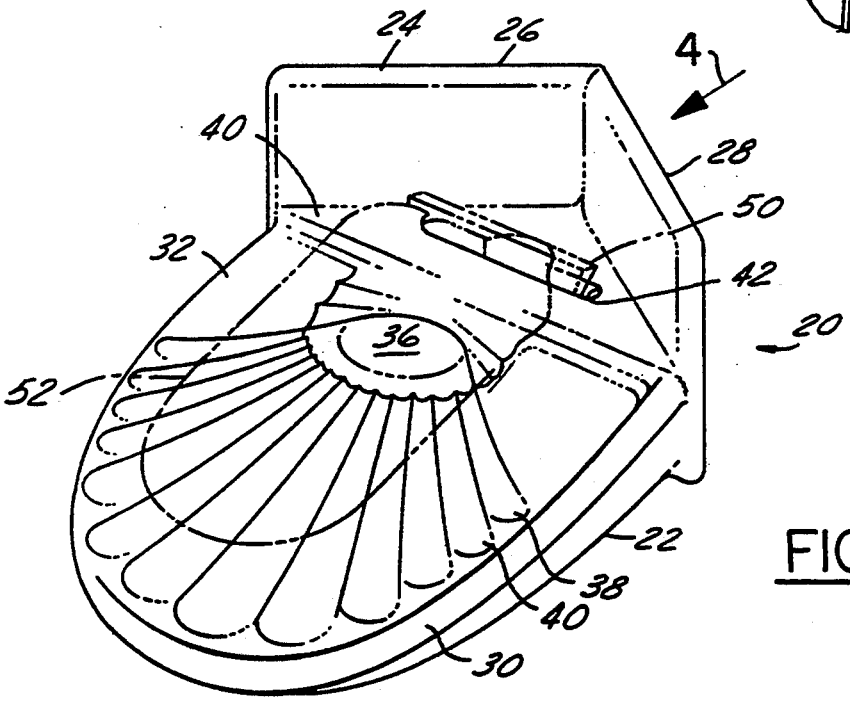
FIG. 3 is a perspective view of one embodiment of the ladies leg shave plate or fixture.

The plate or fixture 20 comprises a unitary body 22 having a vertically extending mount portion 24 comprising of a pair of flanges 26 and 28 separated or spaced 90° apart as best illustrated in FIG. 3 to form a corner for mating with the corner formed by walls 12 and 14.

The unitary body 22 further includes a forwardly extending, downwardly inclined foot portion 30 which is integral with the mount portion 24. The fixture 20 illustrated in FIG. 3 is made from ceramic material like many of the bathroom fixtures which are now in use today. However, it should be understood that the fixture 20 may be made, as an example, from a plastic, metal or rubber material.

The forwardly extending, downwardly inclined foot portion 30 has an upper surface 32 and a bottom surface 34. The upper surface 32 slopes or tapers away from the mount portion 24 at a greater angle then does the bottom surface 34. The angle selected for the upper surface 32 is in the range of 15° to 25°.

The upper surface 32 is provided with a slightly raised center section 36 having a series of outwardly and generally radially extending raised ribs 38, with the ribs 38 separated by slight indentations 40. The purpose of the alternate ribs 38 and indentations 40 is to provide a surface which will assist in preventing the woman from slipping when the ball of her foot is placed on the surface 32 when shaving her leg.

Rearwardly of the surface 32 is an area 40 which is generally flat and horizontal and is located between the flanges 26 and 28. The flat surface or area 40 is provided with an elongated slot 42 having a rear surface 43, a bottom 45 and an enlarged opening 44 which tapers from surface 40 to the bottom 45 to provide a semi-circular configuration which is adapted to receive the handle of a conventional razor. The bottom 45 of the slot 42 is provided with a drain hole 46 which permits water falling upon the surface 40 to drain from the fixture 20. Thus, the slot 42 along with the enlarged opening 44 and the drain hole 46 provide two important functions. One function is to permit water to drain from the fixture 20 and the other function is to provide an area for holding the handle of the razor or the head 50 of a ladies razor 52 as shown in phantom lines in FIG. 3.

Figure 4:
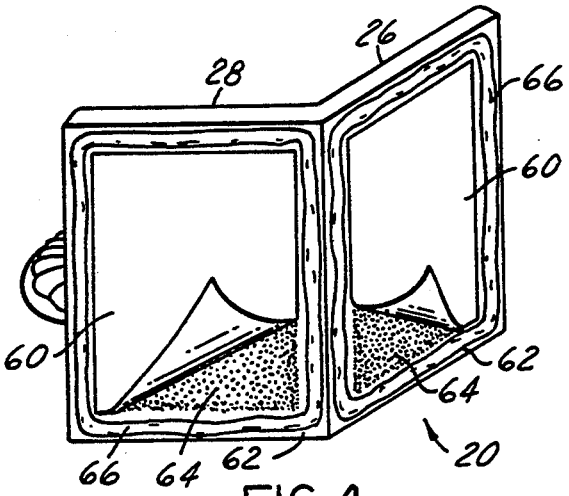
FIG. 4 is a rear view of the fixture illustrated in FIG. 3, looking in the direction of arrow 4 and illustrating the manner in which fastening means are provided on the rear surface of the fixture to permit it to be mounted in the corner of a shower stall.

Referring now to FIG. 4, a method of mounting the fixture or plate 20 is illustrated. A length of double sided adhesive tape of the quality made by 3M Manufacturing Company or one of similar quality is applied to the reverse or back side of flanges 26 and 28. Tape 60 covers the rear surfaces 62 of the flanges 26 and 28 to expose and present an adhesive surface 64 of the tape 60 after the backing is removed. As an alternative, a liquid adhesive of tested quality to hold the shave plate on the wall of the stall shower, either ceramic or fiberglass, may be used. A silicone sealer or other suitable adhesive 66 may be applied around the edges of the fixture 20 as shown in FIG. 4 so as to surround the adhesive tape 60 or sealant. The fixture 20 is then placed within the shower stall 10 at a selected elevation that is selected. It is held against the tile wall 12 and 14 until the tape 60 and the sealant 62 are secured to the tile walls. Thereafter, a suitable ceramic grout, not shown, is used to seal the fixture 20 on the ceramic wall or tile of the shower stall 10.

Figure 5:
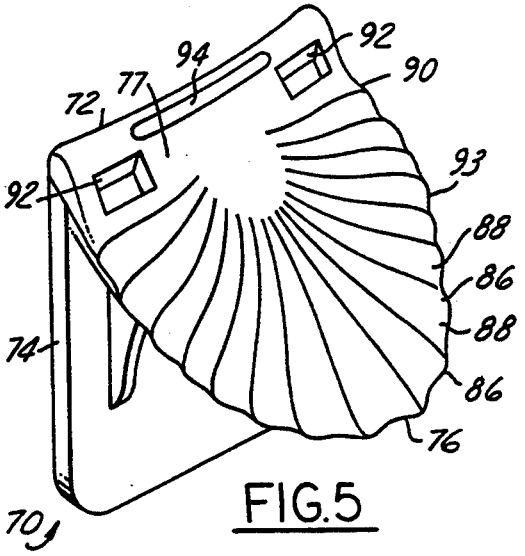
FIG. 5 is a left hand-top perspective view of another embodiment of the ladies leg shave plate.
Figure 6:
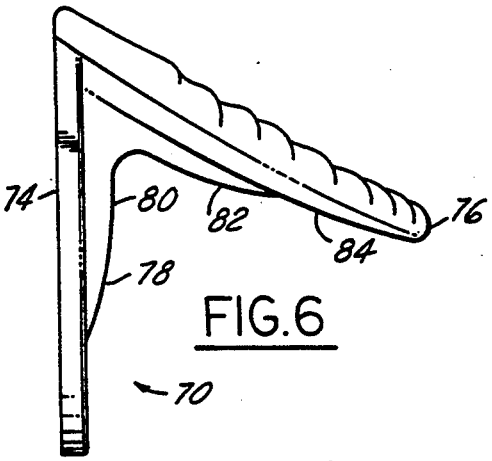
FIG. 6 is a left hand elevational view of the ladies leg shave plate illustrated in FIG. 5.
Figure 7:
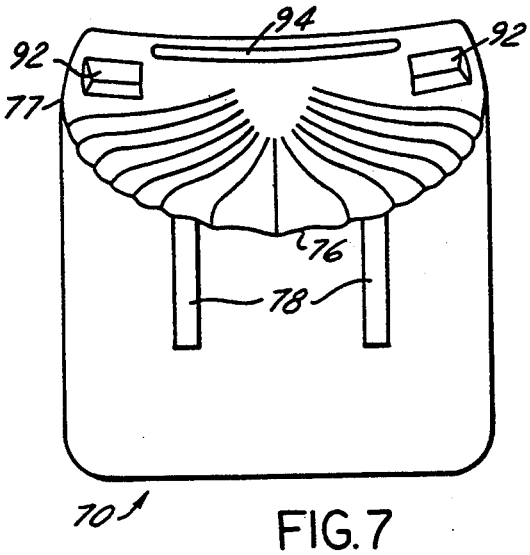
FIG. 7 is a front elevational view of the ladies leg shave plate illustrated in FIG. 5.

A modified ladies leg shave plate is designated by the numeral 70 in FIGS. 5–7 inclusive. The plate or fixture 70 has a unitary or one-piece body 72 including a vertically extending mount portion 74 of generally rectangular configuration and a forwardly extending, downwardly inclined foot portion 76 upon which the woman places the ball of her foot when shaving her leg. The plate or fixture 70 as an example, is made from a plastic material in a mold according to acceptable molding practices. However, it may be made from other suitable material such as ceramic or rubber. The foot portion 76 is inclined downwardly and is interconnected to the vertical mount portion 74 by a pair of brackets 78. The brackets 78 are spaced apart as best illustrated in FIG. 7 and provide support for the forwardly extending foot portion 76 when the ball of the foot is placed thereon. Each bracket 78 includes a pair of legs 80 and 82, with leg 82 being inclined downwardly and connected to the bottom surface 84 of the forwardly extending foot portion 76.

The upper surface 77 of the forwardly extending foot portion 76 has an angle of inclination in the range of 15° to 25°. The upper surface is provided with a series of ribs 84 which extend outwardly from the center thereof to the periphery, with the portions in between the ribs 86 forming indentations 88. The outer edge 90 of the forwardly extending foot portion 76 is provided with scallops 92.

The forwardly extending downwardly inclined foot portion 76 is provided with a pair of generally rectangular openings 92 at opposite sides thereof. The openings 92 permit water to drain from the surface and further provide places where the handles of razors may be placed so as to store them when not in use. The plate or fixture 70 further includes an elongated slot 94 which is shaped to receive the head of a razor of the type illustrated in phantom line in FIG. 3. Thus, the razor may be stored directly on fixture 70 when not in use.

The plate or fixture 70 may be appropriately mounted to the wall of a shower stall or other wall in the bathing area by appropriate fastening means such as that described in connection with FIG. 4. It should be appreciated however, that mechanical fasteners may also be used which extend through the mount portion 74 into the adjacent wall so as to appropriately mount the fixture 70.

Figure 8:
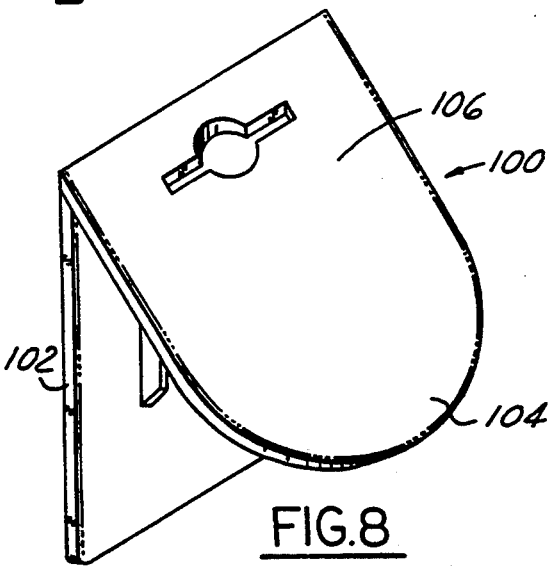
FIG. 8 is a left hand-top perspective view of still another embodiment of the present invention.
Figure 9:
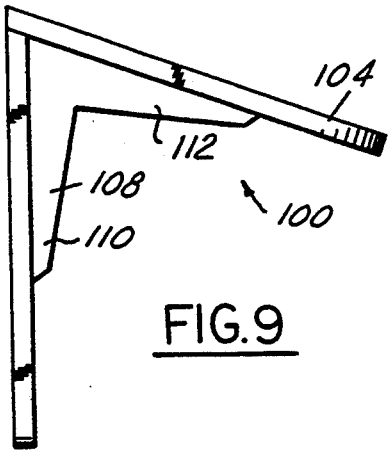
FIG. 9 is a left side elevational view of the ladies leg shave plate illustrated in FIG. 8.

A further embodiment of the ladies leg shave plate or fixture is designated by the numeral 100 in FIG. 8 and 9.

It includes a generally rectangular mount portion 102 and a forwardly extending, downwardly inclined foot portion 104 located at an angle in the range of 15° to 25° . The upper surface 106 of the foot portion 104 is flat and has a smooth surface. The fixture 100 has a unitary body and, as an example, is made from plastic material according to acceptable molding practices. The unitary body includes a pair of generally L-shaped brackets 108 which are spaced laterally apart as with the embodiment in FIG. 7. The brackets 108 each includes a generally vertically extending arm or leg 110 and a downwardly inclined arm or leg 112 integrally connected to the foot portion 104.

The plate or fixture 100 may be appropriately mounted by adhesive fastening tape or by mechanical fasteners to a vertical support surface such as the wall of a shower stall or the wall of the adjacent bathing area.

I claim:

1. A leg shave place comprising:

a unitary body having a vertically extending mount portion and a forwardly extending, downwardly inclined foot portion integral with said mount portion;

said foot portion having upper and lower surfaces, with said upper surface providing an area configured to receive the ball of a user's foot to permit the user to maintain balance while shaving the leg.

2. The leg shave plate as recited in claim 1, wherein said unitary body is made from ceramic material.

3. The leg shave plate as recited in claim 1, wherein said unitary body is made from plastic material.

4. The ladies leg shave plate as recited in claim 1, wherein said unitary body is provided with one or more openings to permit water to drain from said body.

5. The leg shave plate as recited in claim 4, wherein said opening is configured to receive the handle or head of a razor used for shaving.

6. The leg shave plate as recited in claim 1, wherein said vertically extending mount portion comprises a pair of flanges which are integrally connected and spaced 90 degrees apart.

7. The leg shave plate as recited in claim 1, wherein said vertically extending mount portion is flat and of rectangular configuration.

8. The leg shave plate as recited in claim 1, wherein said upper surface is flat and smooth.

9. The leg shave plate as recited in claim 1, wherein said upper surface is provided with a series of raised ribs which help to prevent the ball of the foot from slipping from the fixture.

10. The leg shave plate fixture as recited in claim 1, wherein the upper end of said forwardly extending, downwardly inclined foot portion is provided with an elongated slot designed to receive the head of a razor for supporting same on said body when the razor is not in use.

11. A leg shave plate comprising:

a unitary body having a vertically extending mount portion and a forwardly extending, downwardly inclined foot portion integral with said mount portion;

said foot portion having upper and lower surfaces; and said upper surface having a series of raised ribs separated by indentations to permit the user to place the ball of the foot upon the upper surface to maintain balance while shaving the leg.

12. The leg shave plate as recited in claim 11, wherein said ribs and indentations of the upper surface help in preventing the ball of the foot from slipping from the fixture.

13. The leg shave plate as recited in claim 11, wherein said unitary body is made from ceramic material.

14. The leg shave plate as recited in claim 11, wherein said unitary body is made from plastic material.

15. The leg shave plate as recited in claim 11, wherein said unitary body is provided with one or more openings to permit water to drain from said body.

16. The leg shave plate as recited in claim 11. wherein said vertically extending mount portion comprises a pair of flanges which are integrally connected and spaced 90 degrees apart.

17. The leg shave plate as recited in claim 11, wherein said vertically extending mount portion is provided with a pair of integral, spaced apart, L-shaped members for supporting the forwardly extending, downwardly inclined foot portion.

18. The leg shave plate as described in claim 11, wherein the upper end of said forwardly extending, downwardly inclined foot portion is provided with an elongated slot designed to receive the head of a razor for supporting same on said body when the razor is not in use.

19. A leg shave plate comprising:

a unitary body made from ceramic material;

said body having a pair of angularly connected flanges forming a mount portion to permit said fixture to be mounted to a wall or a support;

said unitary body further including a forwardly extending downwardly inclined foot portion having upper and lower surfaces;

said upper surfaces being spaced below the upper edge of said mount portion, said upper surface having generally radially extending ribs and indentations to permit a person to engage the top surface with the ball of the foot to avoid slipping and maintain balance when shaving the leg; and the bottom surface of said foot portion being generally smooth and also being downwardly inclined.

20. The leg shave plate as recited in claim 19, wherein said upper surface is provided with an opening to permit water to drain from said body.

21. The leg shave plate as recited in claim 19, wherein said opening is elongated and forms a slot to permit the head of a razor to be placed therein and supported by said body when the razor is not in use.

22. A leg shave plate comprising:

a unitary body having a vertical mount portion and a forwardly extending downwardly inclined foot portion;

said foot portion having an upper surface which is provided with a series of raised ribs separated by indentations;

said upper surface assisting and maintaining the ball of the foot on the foot portion to assist in balance and help prevent slipping; and a pair of integral L-shaped brackets interposed between said mount portion and said foot portion, each bracket having a leg, one leg integral with said mount portion and the other leg integral with said foot portion, said legs being spaced apart.

* * * * *